United States Patent [19]

Volbeda

[11] 4,135,318

[45] Jan. 23, 1979

[54] TOOTH POSITIONING ARRANGEMENT FOR AN UNDERWATER SOIL CUTTING HEAD

[75] Inventor: Johan H. Volbeda, Rijswijk, Netherlands

[73] Assignee: Hollandsche Aanneming Maatschappij B.V., Rijswiji, Netherlands

[21] Appl. No.: 700,367

[22] Filed: Jun. 28, 1976

[30] Foreign Application Priority Data

Mar. 19, 1976 [GB] United Kingdom ..... 11283/76

[51] Int. Cl.[2] ..... E02F 3/88

[52] U.S. Cl. ..... 37/67; 299/87

[58] Field of Search ..... 37/67, 64, 189; 299/87, 299/90, 55, 73, 78, 84, 79; 175/397, 376

[56] References Cited

U.S. PATENT DOCUMENTS

| | | | |
|---|---|---|---|
| 369,976 | 9/1887 | Angell | 37/67 |
| 887,506 | 5/1908 | Newcomb | 37/67 |
| 1,316,349 | 9/1919 | Calder | 37/67 |
| 2,340,216 | 1/1944 | Gill | 37/67 |
| 2,705,128 | 3/1955 | McClennan | 175/397 X |
| 3,316,988 | 5/1967 | Petersen | 175/397 X |
| 3,841,707 | 10/1974 | Kniff et al. | 299/84 |
| 3,865,202 | 2/1975 | Takahashi et al. | 175/397 X |

*Primary Examiner*—Clifford D. Crowder

*Attorney, Agent, or Firm*—Sughrue, Rothwell, Mion, Zinn and Macpeak

[57] ABSTRACT

A generally conical cutting head for an underwater dredger includes a plurality of helical cutting arms 1 having teeth 4 mounted thereon. The arms are fixed at one end to a hub 2 and at the other end to a base ring 3. The tooth spacing between the respective cutting arms is arranged in a multi-staggered configuration whereby each tooth removes a symmetrical piece of soil and is not subjected to loads parallel to the local section of the contour line 5'.

3 Claims, 7 Drawing Figures

TOOTH POSITIONING ARRANGEMENT FOR AN UNDERWATER SOIL CUTTING HEAD

BACKGROUND OF THE INVENTION (1) Field of the Invention

This invention relates to a cutting head construction for cutter suction dredgers used for the underwater cutting of rock, earth, ores, clay and sand, hereinafter referred to generically as soil. The cutting head construction is of generally conical shape and comprises a number of helical cutting arms fixed at their one ends to a hub and at their other ends to a base ring. A plurality of cutting teeth are mounted on these cutting arms.

(2) Description of the Prior Art

In the operation of a cutter suction dredger the cutting head is rotated in contact with the soil while simultaneously being swung along successive, generally arcuate paths.

This invention relates in particular to the positioning of the teeth on the arms in positions in which the tooth tips intersect a plane extending through the axis of rotation of the cutting head.

In this respect there are two commonly used arrangements, namely:

(a) The tooth tip positions on all cutting arms coincide; this is called a non-staggered arrangement, and (b) The tooth tip positions on each cutting arm are in between those on the adjacent cutting arms; this arrangement is generally called a staggered arrangement.

The arrangement of tooth tip positions defines the cutting process of a tooth in soil and thus the size and shape of the piece of soil removed per tooth, which is also influenced by the rotational speed of the cutterhead and the swing velocity of the cutter suction dredger.

Due to the generally conical shape of the cutterhead neither the non-staggered nor the staggered arrangement produces a well-balanced cutting pattern in which all teeth cut off substantially symmetrical pieces of soil with substantially normal cutting forces per tooth which are as small as possible so that lateral force action on the tooth is minimized. Normal force or normal load as used herein means the force perpendicular to a plane which: (1) extends through the cutter head rotational exis, (2) extends perpendicular to the cutter head rotational axis, (3) extends through the tooth-tip, and (4) extends parallel to the cutter head base ring.

SUMMARY OF THE INVENTION

An object of the invention is to provide a cutting tooth arrangement in a cutting head so that in operation all teeth cut substantially symmetrical pieces of soil and are consequently loaded normal forces. To this end, the invention comprises a cutting head, particularly for a cutter suction dredger, of generally conical shape and having arms carrying cutting teeth, the cutting teeth being arranged to produce for each tooth a cutting pattern in soil having break lines which are substantially equal. By means of the invention, there is a minimum amount of energy expended by each tooth per unit quantity of soil.

According to the invention the teeth are positioned in a multi-staggered arrangement, i.e. the tooth-tips are staggered with respect to more than two arms so that the tooth-tips on a pair of arms having two or more arms disposed in between them are in the same or substantially the same position.

BRIEF DESCRIPTION OF THE DRAWINGS

The invention will now be further described with reference to the accompanying drawings, in which:

FIG. 3*b* shows the cutting pattern of the staggered arrangement, whereas

DESCRIPTION OF THE PREFERRED EMBODIMENT

Figure 1:
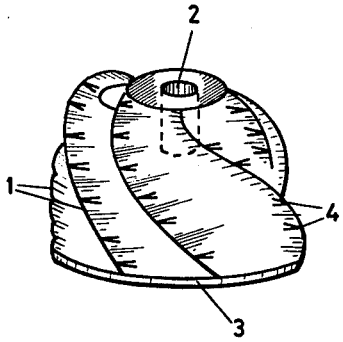
FIG. 1 is a general view of a cutter head of a cutter suction dredger showing a helical arm shape, although the anti-helical configuration also applies.

FIG. 1 shows a number of helical-shaped cutter arms 1 fitted to a hub 2 and a base ring 3, which together form a cutter head. On the cutter arms a plurality of cutting teeth 4 are mounted in order to cut out the soil.

Figure 2:
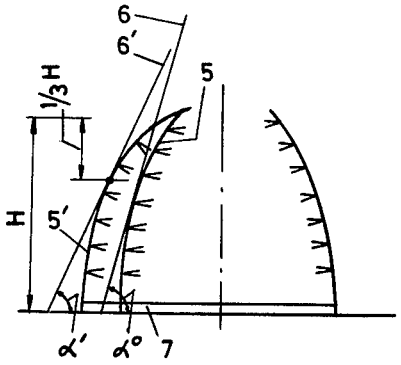
FIG. 2 shows a plane through the axis of rotation of the cutter head in which the curved line through the points of intersection of the tooth-tips with this plane will be called the contourline, FIGS. 3*a, b, c,* are diagrammatic views of a part of the contour-line and succeeding contourlines of the succeeding cutting arms at equal distances from each other in the direction of the swinging movement of the dredger, said distance being defined by the ratio of swing movement per time-unit and the number of cutting arms passing per same time unit.

FIG. 2 shows the points of intersection of the tooth tips with a plane extending through the rotational axis; the curved line through these intersection points being called the contourline 5. As the greatest part of the energy-transfer from the cutting teeth to the soil takes place near the hub of the cutter head, the contourline at this location is approximated by a straight line 6 having an inclination of $\alpha°$ with respect to the base ring line 7. In general, this straight line will touch the contourline at a distance of approximately two thirds of the total height as shown by H above the base ring.

Due to the helical shape of the cutting arms, the teeth start cutting on the upper or lower position depending on the helical or anti-helical configuration. As a result the teeth on a given cutting arm start cutting at succeeding time intervals. Due to the continuous swing-velocity of the cutting head in operation, the actual cut-out contourline 5' will be transformed such that the average slopeline 6' tangent to this transformed contourline differs from the case in which the swing-velocity and helical shape of the arms are neglected.

The slope angle has been shown as $\alpha'$, which in the illustrated case is smaller than $\alpha°$. In the case of an anti-helical configuration, $\alpha'$ would be greater than $\alpha°$.

Figure 3A:
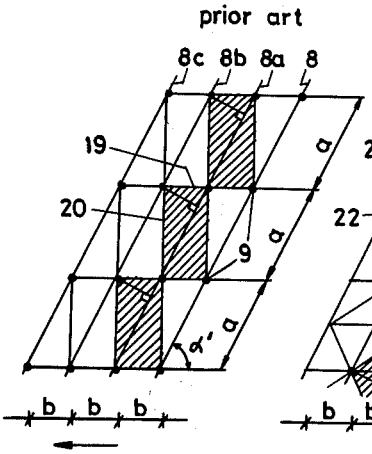
In FIG. 3*a* the cutting pattern of the non-staggered arrangement is shown, in which the shaded areas represent the removed parts of the soil per tooth.

In FIG. 3*a* the straight line approximation 8 is drawn together with the straight line counterparts of the succeeding cutting arms 8*a, b, c* etc. The tooth spacing arrangement is shown by the dots 9, which represent the tooth tips, on the contourlines at a spacing distance a. The distance between the succeeding contourlines is denoted by b.

Figure 4:
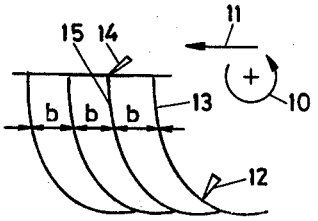
FIG. 4 is a view in a plane perpendicular to the rotational axis of the cutter head showing the origin of the equal distances of the succeeding cutting arms mentioned above.

In FIG. 4 this distance b is shown again in another plane related to the rotational speed of the cutter head denoted by arrow 10, and the velocity of the swinging movement of the cutter head denoted by arrow 11. A given tooth 12 on one cutting arm follows a track 13 through the soil whereas the succeeding tooth 14 on the next cutting arm follows track 15 at a distance b from track 13.

FIG. 3*a* shows the cutting pattern in the non-staggered arrangement of the prior art with the shaded areas representing the soil cut out by the teeth on contourline 8*b*. It can be seen that the projections of the tooth-tip positions of contourline 8*b* on the contourline 8*a* are highly asymmetrical in relation to the teeth on contourline 8*a*, thus producing a cutting pattern in which the break lines 19 and 20 are of unequal length.

Figure 3B:
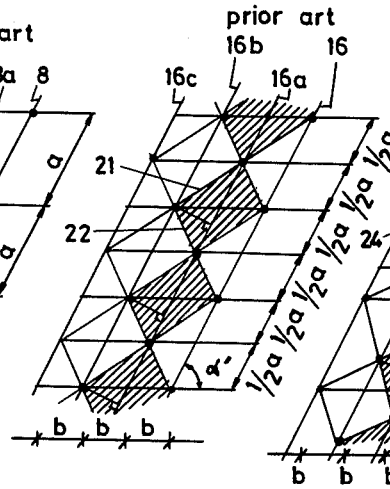

FIG. 3*b* is a diagrammatic view of the cutting pattern in the staggered arrangement of the prior art. The teeth on contourline 16*a* are intermediate those on contourline 16, schematically drawn for convenience of illustration at equal distances a/2. The distance between succeeding cutting arms is again b. From FIG. 3*b* it is seen that the pieces or parts of soil removed by the teeth on contourline 16*b*, again shown as shaded areas, are still asymmetrical in relation to the tooth-tip positions on contourline 16*a*, thus producing a cutting pattern in which the break lines 21 and 22 for each tooth are again of unequal length.

Figure 3C:
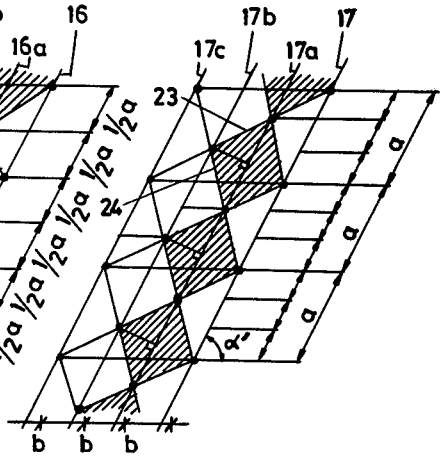
FIG. 3*c* shows the cutting pattern of the multi-staggered arrangement according to the invention.

FIG. 3*c* shows the multi-staggered arrangement according to the invention, in which in the tooth spacing, denoted by a on contourline 17, is subdivided for convenience into three parts. With this arrangement a symmetrical cutting pattern is now obtained in which the break lines 23 and 24 are of equal length, as shown by the shaded areas representing parts of soil cut out by the teeth on contourline 17*b* in relation to the tooth-tip positions on contourline 17*a*.

In FIG. 3*c* the tooth spacing is equally subdivided in three parts, but this is only a consequence of the straight-line schematisation of the contourline and is not essential for the actual curved contourline. Thus, it will be appreciated that the subdivision of the tooth spacing a may be into more than three parts.

Figure 5:
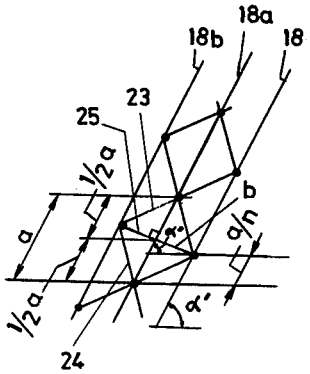
FIG. 5 shows a geometrical layout for demonstrating that there exists a certain relationship between the slope of the contourline relative to the base ring and the required amount of staggering.

FIG. 5 shows the sequence of contourlines 18, 18*a* and 18*b*. In order to obtain a symmetrical cutting pattern in which the break lines 23 and 24 are of equal length, it is necessary that the projections on contourline 18*a* of the teeth on contourline 18*b* subdivide the tooth spacing of contourline 18*a* into two equal parts of length a/2 by dropping a perpendicular 25 to the line 18*a*.

From FIG. 5 it can be seen that the teeth of a cutter arm are staggered with respect to the teeth of adjacent cutter arms over a distance measured along the contourlines which equals $a/2 - b \cos \alpha'$ in which b is the contourline distance in the direction of the swinging movement and $\alpha'$ is the slope angle of the contourline. Now it can be stated that:

$$a/n = a/2 - b \cos \alpha'$$

in which n is the number of subdivisions of the tooth spacing a.

Supposing there is an average relationship between a and b of:

$$a = 2.5b,$$

then by combination $$n\ 10/5 - 4 \cos \alpha'.$$

From this relationship it can be deduced that for a cutter head in which $\alpha' = 90°$, $n = 2$, which corresponds to a normal staggered arrangement. When, however, the slope angle $\alpha'$ of the contourline tends towards 60° - 70°, $n$ equals approximately 3, resulting in a double-staggered arrangement.

An angle $\alpha'$ of 60° - 70° is considered as a good average for a normal applicable cutter head shape.

According to a feature of the invention, the projected centerlines of the teeth on a plane through the rotational axis of the cutter head coincides with and lie on a line 25 perpendicular to the transformed contourline 18*b* in FIG. 5. This arrangement enables there to be a substantially symmetrical load distribution on the cutting teeth, thereby reducing the possibility of their asymmetrical wear.

Although the break lines have been shown as straight for convenience of illustration it will be appreciated that in practice the lines may not be absolutely straight since soils of differing natures may produce variations in the characteristics of the lines.

What is claimed is:

1. In a cutting head construction for cutter suction dredgers used for the underwater cutting of rocks, earth, ores or the like, said cutting head being of generally conical shape and comprising a plurality of helical cutting arms fixed at their one ends to a hub and at their other ends to a base ring, a plurality of cutting teeth being mounted on each cutting arm, the improvement comprising the teeth of the cutting arms being positioned in a multi-staggered arrangement, the distance $a/n$ over which the teeth of a cutter arm are staggered with respect to the teeth of adjacent cutter arms being defined by: $a/2 - b \cos \alpha°$, where a is the tooth spacing on an individual cutter arm, n is the number of subdivisions of the tooth spacing, b is the spacing of contourlines in the direction of the swinging movement of the cutter head in operation, and $\alpha°$ is the approximate slope angle of a contourline, a contourline being defined by a curved line through the points of intersection of the toothtips with a plane extending through the rotational axis of the cutter head.

2. A cutting head construction according to claim 1 wherein: $a/n = a/2 - b \cos \alpha'$ in which $\alpha'$ is the approximate slope angle of a transformed contourline obtained by taking the swinging movement of the cutting head into account.

3. A cutting head construction according to claim 2 wherein the projected centerline of the teeth of the cutting arms on a plane through the rotational axis of the cutting head coincides with a line perpendicular to the transformed contourline.

* * * * *